US008646743B2

(12) United States Patent
Salerno

(10) Patent No.: US 8,646,743 B2
(45) Date of Patent: Feb. 11, 2014

(54) SAFETY STRAP SET FOR PREVENTING TODDLERS FROM CLIMBING ON A CHAIR

(76) Inventor: Thomas M. Salerno, Lackawana, NY (US)

( * ) Notice: Subject to any disclaimer, the term of this patent is extended or adjusted under 35 U.S.C. 154(b) by 1346 days.

(21) Appl. No.: 12/359,805

(22) Filed: Jan. 26, 2009

(65) Prior Publication Data

US 2009/0152914 A1 Jun. 18, 2009

Related U.S. Application Data

(63) Continuation-in-part of application No. 11/050,618, filed on Feb. 2, 2005.

(51) Int. Cl.
*A47B 97/00* (2006.01)

(52) U.S. Cl.
USPC ..... 248/500; 297/170; 297/174 CS; 24/458

(58) Field of Classification Search
USPC ..... 248/500; 297/142, 170, 135; 224/148.6; 119/770, 792
See application file for complete search history.

(56) References Cited

U.S. PATENT DOCUMENTS

| | | | | | |
|---|---|---|---|---|---|
| 76,801 | A | * | 4/1868 | Nichols | 297/130 |
| 85,050 | A | * | 12/1868 | Apel | 297/174 CS |
| 153,724 | A | * | 8/1874 | Schmidt | 54/34 |
| 796,353 | A | * | 8/1905 | Rasmussen | 297/3 |
| 1,182,339 | A | * | 5/1916 | Békési | 297/142 |
| 1,551,932 | A | * | 9/1925 | Carver | 297/466 |
| 1,586,487 | A | * | 5/1926 | Thixton | 297/157.1 |
| 2,145,201 | A | * | 1/1939 | Raeuber | 297/142 |
| 2,348,573 | A | * | 5/1944 | Yubie | 297/142 |
| 2,457,972 | A | * | 1/1949 | Bailey | 248/103 |
| 2,539,698 | A | * | 1/1951 | Pearson | 248/104 |
| 2,700,582 | A | * | 1/1955 | Munsch | 108/91 |
| 3,144,230 | A | * | 8/1964 | Brooks | 248/102 |
| 3,212,815 | A | * | 10/1965 | Wardlaw et al. | 297/170 |
| 3,778,102 | A | * | 12/1973 | Snyder et al. | 297/170 |
| 3,812,852 | A | * | 5/1974 | Konvalin | 128/882 |
| 4,172,453 | A | * | 10/1979 | Leckie | 128/878 |
| 5,147,079 | A | * | 9/1992 | Heather | 224/148.6 |
| 5,333,928 | A | * | 8/1994 | Rollinson | 297/142 |
| 5,335,968 | A | * | 8/1994 | Sheridan et al. | 297/250.1 |
| 5,358,160 | A | * | 10/1994 | Bianchi | 224/244 |
| D356,379 | S | * | 3/1995 | Ibinger | D24/199 |
| 5,397,039 | A | * | 3/1995 | Parcelles | 224/148.5 |
| 5,553,548 | A | * | 9/1996 | Eaton | 104/183 |
| 5,713,630 | A | * | 2/1998 | Kvalvik | 297/254 |
| 5,718,189 | A | * | 2/1998 | Blake | 119/770 |
| 5,749,325 | A | * | 5/1998 | Albanese | 119/792 |

(Continued)

*Primary Examiner* — Terrell McKinnon
*Assistant Examiner* — Daniel J Breslin
(74) *Attorney, Agent, or Firm* — Patricia M. Costanzo

(57) ABSTRACT

A child-safety attachment device is adapted to maintain a self-standing chair secure to a self-standing surface or table such that the seat of the chair is unable to be used by a child as a climbing tool and contains two attachment sets, each comprising a surface attachment part, a length adjustable chair attachment part detachably attachable to the chair, and both parts detachably attachable to each other, such that the chair is held secure to the surface when for one set the surface attachment part is attached to the surface and the chair attachment part is attached to one side of the chair and the two parts attached to each other and for the other set the surface attachment part is attached to the surface and the chair attachment part is attached to another side of the chair and the two parts attached to each other.

15 Claims, 9 Drawing Sheets

(56) References Cited

U.S. PATENT DOCUMENTS

| | | | | |
|---|---|---|---|---|
| D413,984 | S * | 9/1999 | Lindsey | D24/199 |
| 5,971,668 | A * | 10/1999 | Miller | 405/259.1 |
| 6,029,870 | A * | 2/2000 | Giacona, III | 224/148.6 |
| 6,209,147 | B1 * | 4/2001 | Wheaton | 4/496 |
| 6,220,562 | B1 * | 4/2001 | Konkle | 248/500 |
| D454,992 | S * | 3/2002 | Yantz | D30/153 |
| 6,533,148 | B1 * | 3/2003 | Dahl | 224/148.6 |
| 6,675,418 | B1 * | 1/2004 | Armstrong | 5/662 |
| 6,692,072 | B2 * | 2/2004 | Nelson et al. | 297/250.1 |
| 6,761,019 | B2 * | 7/2004 | Earnhart | 54/23 |
| 6,851,393 | B2 * | 2/2005 | Bremm | 119/770 |
| 6,978,918 | B2 * | 12/2005 | Scanlan et al. | 224/148.6 |
| 7,192,084 | B1 * | 3/2007 | Huang | 297/172 |
| 7,204,468 | B2 * | 4/2007 | Kintzele et al. | 248/690 |
| D606,602 | S * | 12/2009 | Marotta | D21/698 |
| D625,512 | S * | 10/2010 | Blaney | D3/215 |
| 8,016,335 | B2 * | 9/2011 | McKay | 294/152 |
| 8,327,808 | B2 * | 12/2012 | Chirico | 119/792 |
| 8,365,685 | B2 * | 2/2013 | Simons | 119/856 |
| 8,408,435 | B2 * | 4/2013 | Refsum | 224/159 |
| 8,413,613 | B1 * | 4/2013 | Smith | 119/797 |
| 8,505,542 | B2 * | 8/2013 | Boxall | 128/879 |
| 2002/0158433 | A1 * | 10/2002 | de Naurois et al. | 280/33.993 |
| 2004/0245298 | A1 * | 12/2004 | Refsum | 224/159 |
| 2006/0163301 | A1 * | 7/2006 | Rhodes et al. | 224/409 |
| 2006/0289713 | A1 * | 12/2006 | Kaplan et al. | 248/311.2 |
| 2007/0046079 | A1 * | 3/2007 | Huang | 297/172 |
| 2007/0222271 | A1 * | 9/2007 | Henry | 297/463.1 |

* cited by examiner

SAFETY STRAP SET FOR PREVENTING TODDLERS FROM CLIMBING ON A CHAIR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to a child safety device and, more particularly, to a safety-strap set that provides for securing chairs under tables to prevent infants and toddlers from using the chair seats to climb on to reduce the risk of injuries to the child.

Toddlers attempt to satisfy their curiosity by energetically exploring their environment. Generally, this behavior is encouraged, as it is well-accepted that an important part of the overall learning process is engaging in first hand experience. However, a toddler's desire to learn about the environment must be tempered by the realization that a toddler's learning could include activities that pose risks to the safety of the toddler. Toddlers continue to practice simple motor activities, such as walking and climbing for some time. However, their lack of surefootedness at this stage frequently results in the toddler undergoing a moment of imbalance that results in a fall. Most such tumbles are harmless and quickly dismissed by both toddler and caregiver. There are times, however, when such a fall results in injury, sometimes serious. Therefore, parents, grandparents, babysitters, and the like, often attempt to child proof the toddlers surroundings to reduce the risk of injury while allowing the curious toddler to explore the world around them.

Even the most well-meaning caretaker is unable to keep a close eye on the toddler under their care every moment of each day—there are just too many other daily happenings that demand their attention, even if only momentarily. Toddlers, despite their lack of dexterity, are incredibly quick moving. This, coupled with their size, can make monitoring and restraining the toddler extremely difficult for parents and babysitters, let alone for older relatives. A toddler's quickness, coupled with his or her curiosity, can lead to some potentially serious situations.

One of the more dangerous activities toddlers indulge in is climbing. Toddlers are fascinated with objects that are within their sight, but out of their reach, such as an object on top of a kitchen or dinning room table. In order to satisfy their curiosity, or simply to retrieve a desired object, a toddler is likely to think of a way to get the desired item. In many cases, especially when the object of their desire is sitting on top of a kitchen or dinning room table, a toddler will resort to using a chair as a climbing tool. As toddlers are not yet competently dexterous, their attempts at using a chair for climbing, coupled with the inherent instability of a chair when used in this manner, may result in a potentially dangerous fall. Additionally, because of their quick, and often unanticipated movement, the entire climbing event and subsequent fall, could easily happen while the parent, grandparent, or babysitter has only momentarily averted their attention from the toddler, such as to answer the telephone or the doorbell.

The reason chairs are so appealing and dangerous to the toddler is that, unlike some other items in a house, chairs, especially those used routinely by a kitchen or dinning room table, are readily accessible to the toddler. Such table chairs are light weight, and thus, easily moved by the child, also such chairs are relatively easy for a toddler to climb onto and are quite difficult, if not impossible, to child proof. Unlike doors that can be latched or wall plugs that can be capped, there is no readily available means to secure a chair that is used for sitting at a table to that table. Because a means to child proof these kinds of chairs is lacking, caregivers must constantly be concerned about a child taking the opportunity to use the chair as a climbing tool, and possibly injuring themselves in the process. Thus, it is quite clear that there a pressing need for a means and method of securing a chair under a table.

There are some means available for keeping children, especially toddlers, from using a chair as a climbing means to climb onto a table or counter top, but they all seem to have shortfalls. Such means all involve not a means for securing the chair, but constitute some means of restraining the infant, such as by placing the child into a playpen. But, older toddlers are likely to climb out of the typical playpen, which presents another hazard to the safety of the child. Alternatively, young children may be secured by a leash-type device to some safe area of the house. Leasing a child, however, is not acceptable to most caregivers and certainly is not by the child. Such restraining means do not answer the need for a way to child-proof chairs that are used for sitting at a table. The ideal device to child-proof chairs used for sitting at a table should be easy and cost effective to manufacture, thus being affordable for all. Also, the device should be easy to use and ideally operable using only one hand. The necessity of this one handed operation is two fold. First and foremost, not all persons using this device would be the most dexterous, especially if used by grandparents to protect their grandchildren. Secondly, one may not have both hands free to use the device, which is especially true in a household with small children. Thus, the fewer parts required to make the device operable, the more attractive it becomes.

In addition to offering single-hand operation, ease of manufacturing, and being cost effective; there are other practical considerations that should be considered. For one, the device should be able to be adapted to fit differently sized and styled chairs and tables. The device should also be portable so that it may accompany the child when traveling. For the atheistic sake, the device should be unobtrusive. As, toddlers are only toddlers for a short period of time and the time period during which there is a need for such a device it limited, the device should detachable. Likewise, if a new table and chairs are purchased, having a detachably attachable device would eliminate the need to purchase a second device, providing both a cost and time savings.

SUMMARY

Accordingly, the present invention meets the heretofore unmet need by providing for a device and a method of using the device to child-proof self-standing chairs that are used mainly for sitting at a self-standing dinning or kitchen table or other such surface. The device consists of a pair of two-part safety-strap attachment sets that easily, rapidly, and effectively secure chairs to the table so that the chair seats are secured under the table or other surface to prevent a young child from using the chair seats for climbing. One part of the two-part safety-strap attachment sets is used to secure one side of a chair to the table and the other of the two-part safety-strap attachment sets is used to secure the opposite side of the chair to the table. When both sides of the chair are secured to the table, a child is prevented from using the chair's seat for climbing. Each of the two-part safety-strap attachment sets includes a surface (or table) attachment part that is attached to a surface or table (likely to the underside of the table or surface), and a length-adjustable, detachably attachable chair attachment strap part that is attached to the chair. The chair attachment strap part is detachably attachable to the surface attachment part to provide for securing the chair to the surface so that the chair, and especially the chair seat, cannot be used by an enfant for climbing. The pair of two-part safety-straps may be used to secure a chair to a table using only one hand, thus, providing for the other hand to, for instance, hold onto the toddler, if required. The device is simple to manufacture requiring only straps and buckles and/or snaps. The materials required for manufacture are all low cost and readily available, thus making manufacture cost-effective and further, allowing the device to be generally affordable. The universal design of the device allows it to be used with most tables and chairs, provides for the device to be portable, so that it may accompany a child when traveling, and is unobtrusive when in use.

The surface or table attachment part is installed to the underside of a kitchen or dinning room table or other surface by either mechanical or adhesive means. The surface or table attachment part may be fixedly or detachably attached to the table or surface. Maintaining the surface attachment part securely attached to the table or surface provides for a chair to be quickly and easily attached, using the chair attachment part, to the table to keep the chair inaccessible to a small child thereby eliminating the possibility of a child using the chair for climbing and the attendant possibility of ensuing injuries.

The chair attachment part, which will be referred to as a strap or strap part, is secured to a chair by slipping one end of the strap around a part of a chair, such as the arms of the chair or the back supports rungs of the chair, and then detachably attaching that end of the strap to itself, thus, forming a loop about the chair part. To form the loop the strap is held to itself either by a buckle, made of plastic, metal, fiberglass, or the like, or by series of snaps, where the buckle or the series of snaps allow for the length of the strap to be adjusted, and all of which are easy to manufacture. Once the chair attachment strap is thusly secured to a chair, the chair attachment strap is secured to the table or surface attachment part that has been previously secured under a table or other surface to prevent the possibility of the chair being pulled away from the table, thereby preventing a toddler from using the chair as a climbing means.

The length of the chair attachment strap is adjustable to provide for a snug fit between the chair and the table. The table attachment part may have a short length of strap attached to it to provide extra ease in securing the chair attachment part to the table attachment part. If the chair has no arms, the strap parts may be attached to one of the back rungs of the chair. Once the chair is securely attached to a table the chair attachment strap would be shortened to provide for the seat of the chair to be completely under the table. In the case where the chair has arms, such as for a Captain's chair, the attachment strap may be secured to a side arm rung to position the chair tightly against the table (in the situation where the arms prevent the chair from going under the table) so that a child is unable to use the chair for climbing.

Overall the device is lightweight, easy to use and manufacture, and provides an extra degree of safety in the home environment. There are no complex mechanical parts that could break down, require frequent replacement, or would require large amounts of manufacturing time to create. Also, the number of parts required to manufacture the device is quite small. At most, it would require five distinct parts in order to fully implement the device.

Very little effort is required to couple the chair attachment strap part to the table attachment part, providing for even a person with minimal dexterity to child-proof table chairs. Tightening the straps also may be accomplished single handedly, as well, allowing the other hand to be available for other duties as may be necessary for a person taking care of a toddler.

The current invention also provides for adaptability of use. Since it consists of very few pieces, very little adjustment is required. The strap is in fact the most adjustable piece and depending on the length of the strap, it can be placed on any convenient position on a chair, thus providing for its use to any number of chair designs.

The means that are used to secure (affix) the table attachment part of the attachment means to the underside of a the table address the need for reversibility of affixation. When a mechanical affixing means, such as a screw, or a non-mechanical affixing means, such as double sided adhesive is used to affix the table attachment part to the underside of a table, it can be removed as required by a user, without any marks showing on the visible top surface of the table and only minimal screw holes marks, if such affixing means are chosen, visible from beneath the table top. The chair attachment strap is easily removed from a chair by unbuckling or unsnapping it from the chair. These attachment methods do not destroy or damage the device, allowing it to be reused at a later time, or with another table. It should also be understood that the means for attaching the table attachment part to a table or other surface, the means for attaching the chair attachment strap part to a chair, and the means for attaching the table attachment part to the chair attachment part may differ from the means used for illustration herein. The fact that these parts are to be attached, and in some cases detachably attached is part of the invention. Hence, however any of the attachments are accomplished is within the scope of the invention.

All of these advances and advantages are made available by providing an for an attachment device adapted to maintain a self-standing chair secure to a self-standing surface such that the seat of the chair is unable to be used as a climbing tool, wherein the attachment device further comprises a pair of attachment sets, each set comprising a surface attachment part, a chair attachment part, the chair attachment part being length adjustable and detachably attachable to the chair, and both parts detachably attachable to each other, such that the chair is held secure to the surface when for one set the surface attachment part is attached to the surface and the chair attachment part is attached to one side of the chair and the two parts attached to each other and for the other set the surface attachment part is attached to the surface and the chair attachment part is attached to another side of the chair and the two parts attached to each other.

The surface attachment part of the attachment device is attachable to a surface using a surface attachment means that may be a bolt attachment means, a screw-like means, or an adhesive means.

The surface attachment part attachable to an underside of the surface further may have a grommet snap providing for detachably attachment of the chair attachment part to the surface attachment part.

The surface attachment part and the chair attachment part may be attachable to each other using a side release buckle clip, where a first part of the side release buckle clip is attachable to the surface attachment part using a connector.

The chair attachment part may be a strap having a first end and a second end, where the first end comprises a second part of the side release buckle clip.

The second end of the strap may be structured into a loop for the detachable attachment of the second end of the strap about a part of a chair, where the second end further comprises an adjustable slide buckle to affix the second end of the strap to itself to form the loop or where the second end of the strap is fitted with one or more adjustable grommet snaps to affix the second end of the strap to itself to form the loop. The loop is looped around a portion of the chair and the portion of the chair may be any part of the back of the chair.

The surface is contemplated to include a free-standing table, such as a dinning room table or kitchen table, with at least one leg supporting the table on a surface, such as a floor and the chair being a typical dinning room or kitchen chair having at least one leg supporting the chair on the surface, such as the floor.

The attachment device adapted to maintain a self-standing chair secure to a self-standing surface may also be described as a child safety device, comprising:

a pair of two-part sets, each set including a table attachment part having at least one leg supporting the table on a surface, and a length-adjustable strap detachably attachable to a free-standing chair having at least one leg supporting the chair on the surface, the table attachment part and the strap detachably attachable to each other, so with the table attachment part of each set attached to the table and the strap of each set attached to opposing sides of the chair and attached to its respective the table attachment part, the chair is held secured to the table preventing the chair being used for climbing.

A method for preventing a child from using a chair for climbing is also presented where the method comprises:

providing for a pair of two-part sets, each set including a table attachment part attachable to a table having at least one leg supporting the table on a surface, and a length-adjustable strap detachably attachable to a free-standing chair having at least one leg supporting the chair on the surface, the table attachment part and the strap detachably attachable to each other, and attaching the table attachment part of each set to the table, attaching the strap of each set to opposing sides of the chair, and attaching each strap to its respective the table attachment part, the chair is held secured to the table preventing the chair being used for climbing.

Furthermore, the invention also contemplates the attachment means being sold in a kit, wherein a kit may comprise any reasonable number of attachment means to provide for child-proofing an entire set of chairs and also, if desired, including additional table attachment means so that the other attachment means may easily be taken along with the child when traveling, to a vacation home or to grandparent's home, for example.

BRIEF DESCRIPTION OF THE DRAWINGS

In order that these and other features and advantages of the present invention may be more fully comprehended, the invention will now be described, by way of example, with reference to the accompanying drawings, wherein like reference characters indicate like parts throughout the several figures, and in which.

DEFINITIONS

Figure 1:
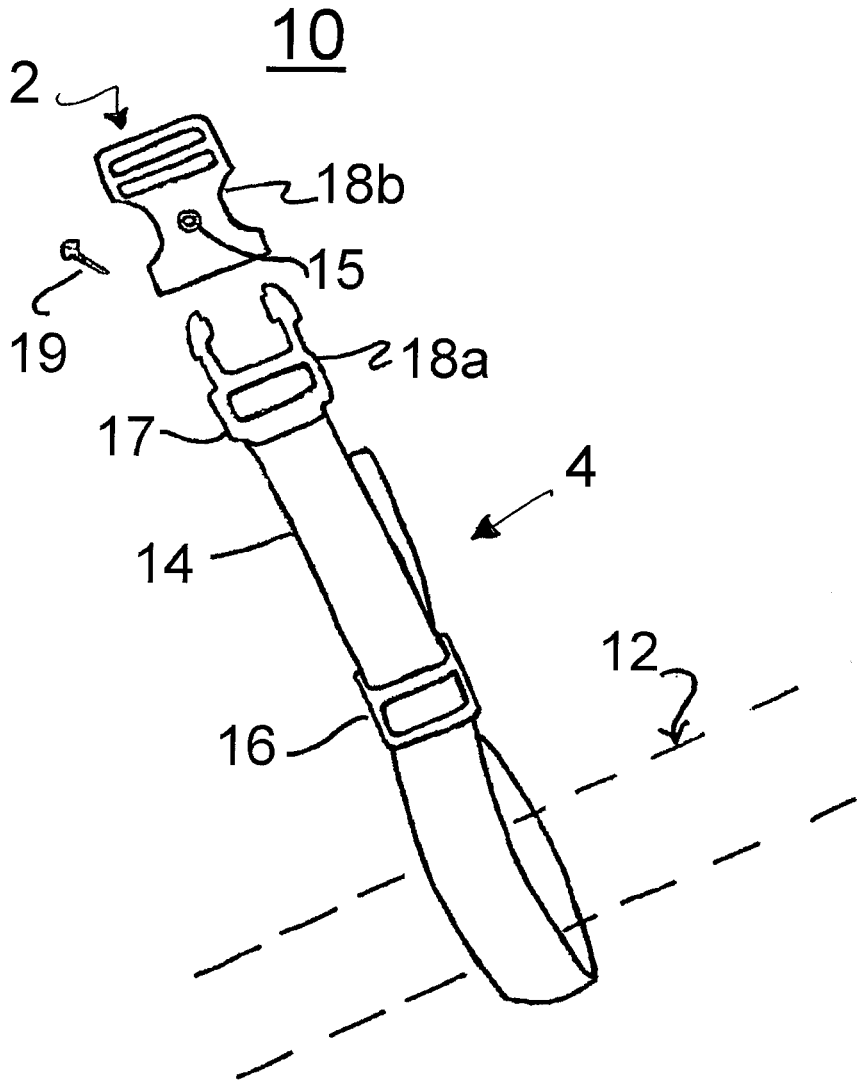
FIG. 1 is a perspective view of a two part safety-strap, made according to the principles of the invention, providing for the attachment of a chair to a table, using, in this case, a strap having a side release buckle and an adjustable slide buckle.

Side Release Buckle Clip, as used herein represents all clips wherein a portion of the clip, hereinafter referred to as the male portion, slides into, fits inside, and locks securely in the second portion of the clip, hereinafter referred to as the female portion. Releasing the male portion from the female portion requires the operator to apply pressure to one or both sides of the combined clip, thus mechanically releasing the male portion from the female portion.

Grommet Snap, as used herein comprises of all snaps wherein a portion of the snap, hereinafter referred to as female portion, fits on top of, and locks over another portion of the snap, hereinafter referred to as the male portion, after sufficient force is applied to the top of the female portion. Releasing the female portion from the male portion requires the operator to pull the female portion away from the male portion with enough force to separate the two halves.

A LIST OF THE REFERENCE NUMBERS AND RELATED PARTS OF THE INVENTION

2 A surface or table attachment part.
4 A chair attachment part.
10 An exemplary illustration of a favored embodiment of a two part safety-strap attachment device, made according to the principles of the present invention, wherein the chair attachment part is equipped with a slide buckle for adjusting the length of the chair attachment part (strap) and a male part of a side-release buckle coupler means, and the table attachment part is equipped with a screw-on type attachment means for attaching the table attachment part to an underside of a table and is also equipped with a female part of the side-release coupler for receiving the male part of the coupler.
11 A self-standing table or surface.
12 A self-standing chair or a part of a chair.
14 A chair attachment part of the safety-strap device, illustrated as a strap.
15 A connector means for accepting affixing means 19 for fixedly or detachably attaching table attachment part 18*b* to table or other surface.
16 Means for adjusting the length of strap 14, in this case an adjustable slide buckle.
17 Means of attaching strap 14 to male part of the coupler 18*a*.
18*a* A first part of the coupler means; in this case the male part of side release buckle.
18*b* A second part of the coupler means; in this case the female part of side release buckle.
18*c* A means of attaching short strap 30 to the female portion of side release buckle clip 18*b*.
18*d* A means of attaching chair attachment strap 14 to the male part of side release buckle clip 18*a*.
19 A screw, bolt, or the like, for affixing the table attachment part 18*b* to the underside of table 11.
19*b* An aperture with a grommet for accepting 19.
20 Adhesive, or a two-sided sticky tape, or the like, for an alternative means of affixing the second part of the attachment means 18*b* to the underside of table 11.
24 Another embodiment of the safety-strap, made according to the principles of the present invention, wherein grommet snaps are used to attach a strap to itself and to the underside of a table.
25 A snap used to adjust the size of a loop made by snapping one end of a safety-strap to itself after it has been looped about a part of a chair.
26 A male part of a grommet snap attachment.
27 An adhesive-backed attachment block for attaching 28 to the underside of a table top.
28 A female part of the grommet snap attached to a screw that is to be used for securing the male part of the grommet snap to the underside of a table.
30 Short strap part.

It should be understood that the drawings are not necessarily to scale. In certain instances, details which are not necessary for an understanding of the present invention or which render other details difficult to perceive may have been omitted. It should be understood, of course, that the invention is not limited to the particular embodiments illustrated herein, but is disposed to embodiments in various sizes, shapes, and forms and, thus, encompasses many embodiments as are discussed throughout the specification. Therefore, the embodiments described herein are provided with the understanding that the present disclosure is intended as illustrative and are not intended to limit the invention.

DETAILED DESCRIPTION

An attachment device providing for a self-standing chair to be easily and effectively secured under or to a table. The device consists of a chair attachment part that is illustrated a being a strap of any serviceable material, a table attachment part, and a coupler, with one part of the coupler being a part of the table attachment part and the other part of the coupler being part of the chair attachment part. The coupler provides for the chair attachment part to be coupled to the table attachment part to provide for a chair being held firmly beneath or securely to a table or other like surface. In the example discussed below, the coupler is a side release buckle with a male end being attached to the chair attachment strap and a female end being attached to the underside of a dinning type table. It should be understood that switching the positions of the male and female parts of a side release buckle is within the contemplation of the present invention. The coupler is contemplated to be made of any functional material, including, but not limited to metal or plastic. Another material that would be considered would be fiberglass. Using plastic as the material with which to make the attachment means has the advantage of the savings gained by the use of injection-type molding processes. Moreover any type of coupler, known or yet to be known, that will serve to couple the table attachment part to the chair attachment part is within the realm of the present invention.

One part of the coupler is secured to the strap by the means available on the couple and shown in the drawings, and the second part of the coupler is attached to the table attachment part. In some instances, the coupler may be the table attachment part that is secured under a table top. This is within the scope of the present invention. The table attachment part is secured to the table, either fixedly or detachably, using either mechanical or adhesive-type means, which is especially useful when the table attachment means is to be attached to a glass table top. The chair attachment strap part is provided with either snaps or buckles. The snaps or buckles provide for two functions; it provides for the length of the strap to be adjusted and provides the means to secure one end of the strap to itself after the strap is positioned about a chair part, thus, coupling the strap to the chair. If required, at this point, the strap may be adjusted to provide for a snug fit. To make the act of detachably attaching the chair attachment part to the table attached attachment part more convenient, a length of strap may be inserted between the table attachment part and the strap coupler part. Overall the device is easy to use and manufacture, lightweight and low cost, and provides an extra degree of safety in the home environment.

Referring now particularly to the drawings, FIG. 1 represents a perspective side view of one exemplary embodiment of the safety-strap attachment device according to the principles of the present invention. Device 10, as described in detail below, demonstrates how the above mentioned heretofore unmet needs for securing chairs under tables to prevent the chairs from being used for climbing have been met. It is also important to note, that while the device is envisioned to be used on self-standing chairs for dinning or kitchen tables, this device can be used on self-standing chairs used with any type of table, such as a desk or work table, where securing the chairs under the table will prevent their use by a child as a means to climb is desired.

Figure 3:
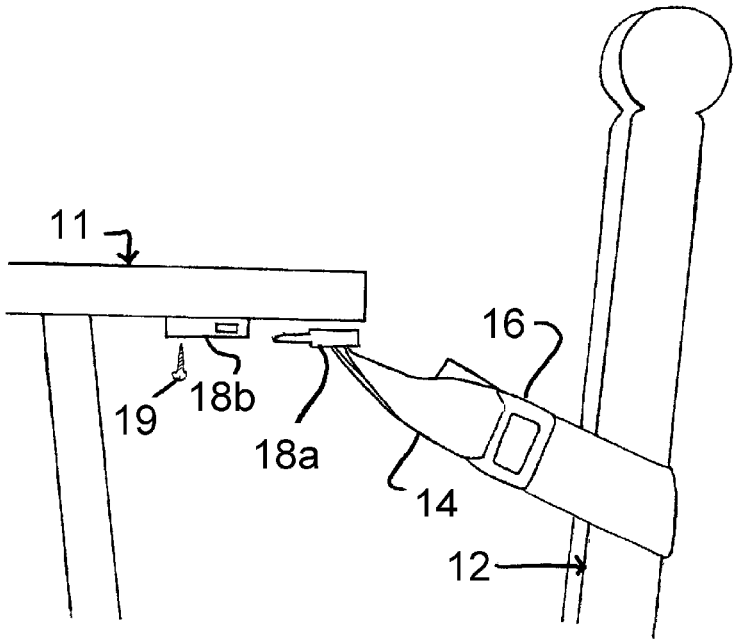
FIG. 3 is a partial perspective, side view of the safety-straps as illustrated in FIG. 1 and FIG. 2, wherein a female part of the side release buckle attachment means that is fixedly attached to an underside of a table be means of a screw, or the like, is ready to accept a male part of a side release buckle attachment means, which is fixedly attached to the strap wherein the strap is secured about a chair, providing for the secure attachment of the chair beneath the table.

More specifically, a first embodiment, illustrated by device 10 in FIG. 1, basically consists of a table or surface attachment part 2, a chair attachment part 4, which in this example is essentially a strap, herein strap 14, and a coupler having a first part 18*a* attached to the chair attachment part and a second part 18*b* attached to the surface attachment part and where first coupler part 18*a* and second coupler part 18*b* are detachably attachable to each other. First coupler part 18*a*, in this example, is adapted to have a "male" structure, i.e., a structure for inserting into a receiving part and second coupler part 18*b* being a "female" portion, i.e., a structure adapted for receiving a part. It will readily be understood by those of ordinary skill in the art that the coupler can be of any known, or yet to be known, conformation that will provide for the first part and the second part to be detachably attached to each other. A person having ordinary skill in the art would additionally realize that either the male portion 18*b* or the female portion 18*a* could interface with the strap 14. Continuing with FIG. 1, male part 18*a* of the coupler is attached to a first end of strap 14 using an attached securing device 17, which in this case is a simple friction holding buckle device. Female portion 18*a*, with accompanying screw 19, is shown ready to be attached to the underside of a table top, which attachment is shown in FIG. 3.

Fitted onto a second end of chair attachment strap part 14 (often herein simply referred to as strap or strap part) is slide buckle 16. Buckle 16 may be made of any suitable material, which materials will be readily appreciated by those having ordinary skill in the art, although as illustrated, the buckle is made of plastic to realize low material cost and ease of manufacture. Of course, if additional durability is desired, metal may be used and fiber glass is always a reasonable material choice. Additionally, buckle 16 can be of any desired conformation and style, though for the illustration a traditional friction based buckle is shown.

Strap 14 can be made from any strong, yet pliable material, which may or may not have any elastic give, depending on the material used. Materials that could be used for the strap 14 include, but are not limited to, natural and synthetic fabrics, web weaves, plastics, polymers such as polyvinyl chloride, or any other material that can be conformed into a viable strap.

Figure 2:
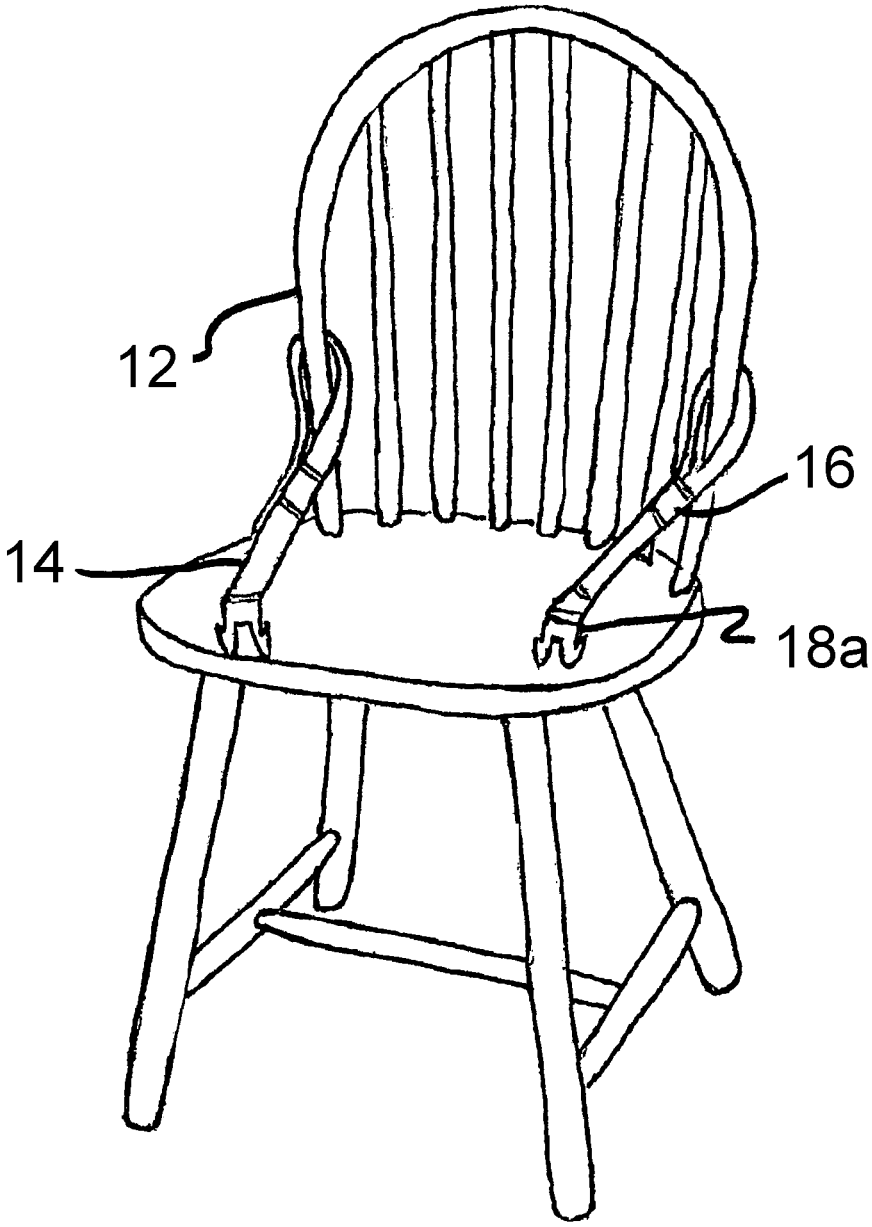
FIG. 2 is a front perspective view of a pair of safety-straps, as illustrated in FIG. 1, attached to support posts of an open backed-chair, ready for the purpose of attaching the chair to a table.

Strap 14 is to be secured to chair 12 (shown in dashed lines in FIG. 1). Strap 14 may be secured to any part of the chair 12, or portion thereof, where the strap 14 would not be at risk of slipping off. Also, the location chosen for wrapping the strap 12 should be one where the structure of the chair permits the second end of strap 12 to be brought back to be secured to itself, as well as providing enough length on the strap to provide for ease in the securing process. Once brought around a portion of chair 12 (effectively forming that end of the strap into a loop to be the chair attachment mechanism) strap 14 is then secured in securing device 16, which is a slide buckle in the preferred embodiment illustrated in FIG. 1. It should be realized that to prevent the chair from being pivoted out from the table, two straps 14 should be secured to chair 12, as shown in FIG. 2. And, of course, two table attachment parts per chair should be utilized. Straps 14 are not limited to being attached to the back of the chair 12, but could be attached to the legs of the chair, or to any other part of the chair 12, as long as the second end of straps 14 are able to be secured to themselves via securing devices 16 while providing for a sufficient amount of strap length so that the "male" portion of the buckle clip 18*a* is able to reach the desired location for attachment with the "female" portion 18*b*.

One way to use device 10 is illustrated in FIG. 3. Here the "female" portion 18*b* of the coupler (note that in this embodiment the female part of the coupler is also the table or surface attachment part) is attached to the underside of table 11 via screw 19 (shown in an unscrewed position only for illustrative purposes). Strap 14 is shown secured to chair 12, more specifically the strap is secured to a back support of chair 12 and is secured in this position using friction buckle 16. "Male" 18*a* portion of the coupler, which is shown attached to strap 14 via friction securing device 17 (see FIG. 1), is positioned to be snapped into the "female" portion 18*b* of the coupler that has been secured under the table 11. Strap 14 may be tightened (by shortening the strap) about chair 12 via slide buckle 16 providing for the chair to be secured under the table, quickly and easily. Depending on the size of the chair, the tightening of the slide buckle 16 is able to be accomplished single handedly.

Figure 3A:
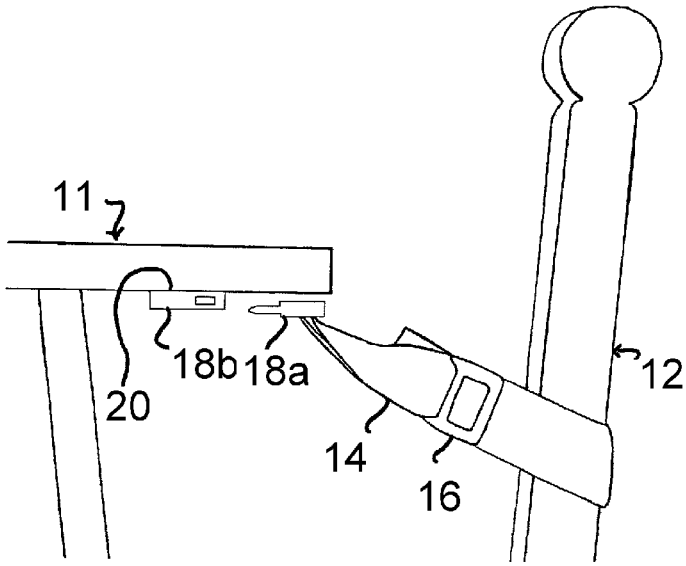
FIG. 3*a* is a partial perspective, side view of a safety-strap, as illustrated in FIG. 3 1 illustrating the female part of the side release buckle attachment means fixedly attached to an underside of a table by means of an adhesive or a two-side adhesive tape.

FIG. 3*a* illustrates an alternative means of securing "female" portion 18*b* coupler/table-attachment to table 11. In this embodiment, portion 18*b* is secured to the underside of a surface by an adhesive, as indicated by reference character 20. The adhesive can be any of a variety of possibilities, including, but not limited to, double sided tape, rubber cement, or any other adhesive that provides for the joining or attaching of one surface to another. The use of hook and loop attachment means if also contemplated. When a screw, or other mechanical attachment device means, would be impractical, undesirable, or impossible to use, one of the adhesive attachment means could be used instead. Such cases would be when table 11 is made of glass, stone, is an antique or any similar situation.

Figure 3B:
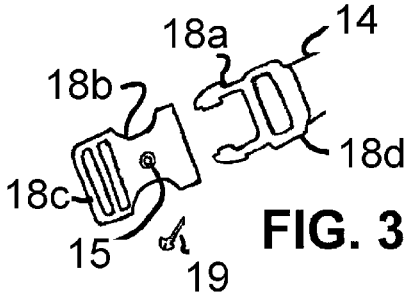
FIG. 3*b* is a detail of the male and female parts of the side release buckle attachment means, illustrating the location for the insertion of a screw that may be used to attach the female side release buckle part to an underside of a table.

A close-up view of the interface between male 18*a* and female 18*b* portion of the coupler is illustrated in FIG. 3*b*. Here it is obvious how the male portion 18*a* of the coupler is attached to strap 14 by use of integrated connection device 18*d*, which in the illustrated embodiment allows strap 14 to be threaded through integrated connection device 18*d* portion of male portion 18*a* of the buckle clip. Female potion 18*b* of the buckle clip has aperture 15, through which screw 19 can be inserted for attachment of female portion 18*b* to a table (not shown here). Additionally, as illustrated in FIG. 3*a*, female portion 18*b* as illustrated in FIG. 3*b* could be equipped with a double sided adhesive tape, or other adhesive or attachment means (not shown here) to have female portion 18*b* anchored to the table (not shown here). Also illustrated is integrated connection device 18*c* that is part of the female portion 18*b* of the coupler.

Figure 3C:
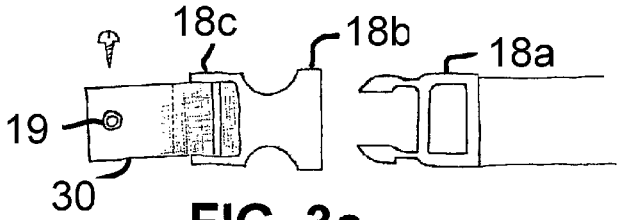
FIG. 3*c* is detail of the male and female parts of the side release buckle attachment means, utilizing a short connector strap piece in which a means for the insertion of a screw is placed.

The use of integrated connection device 18*c* is shown in FIG. 3*c*. Here, male portion 18*a* of the coupler attaches to the strap 14 by use of integrated connection device 18*d*, as was shown in FIG. 3*b*. Female portion 18*b*, however, in FIG. 3*c*, is illustrated connected to short strap 30 which is a shortened version of strap 14 allowing female part 18*b* to be connected to a table either by a screw 19 going through aperture 19*b* in strap 30, or by a double sided adhesive (not shown) as suggested previously in FIG. 3. Short strap 30 can be made of any functional material, but in the example shown, is contemplated to be made of the same material as strap 14. The addition of short strap 30 to female part 18*b* provides for some mobility of the female portion of the buckle clip 18*b*, allowing for greater ease of connection to male portion 18*a* of the buckle clip. Therefore, it should be understood that short strap 30 can be of any length, however, it should be noted that while that ease of use is a consideration, there are other considerations in determining the length, as required by the user. These considerations include, but are not limited to ensuring that when not in use coupler part 18*b* would be kept discreetly out of site; that it would not be hanging down from the table 11 in an unsightly manner and so it would not pose a risk of injury to a person sitting at the table.

Figure 4A:
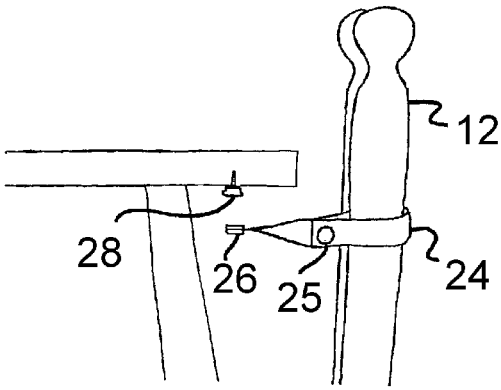
FIG. 4*a* is a partial perspective side view of another embodiment of a safety-strap, wherein a strap is attachable to itself to form a loop about a chair back support and to the underside of a table using grommet snaps attachment means.
Figure 4B:
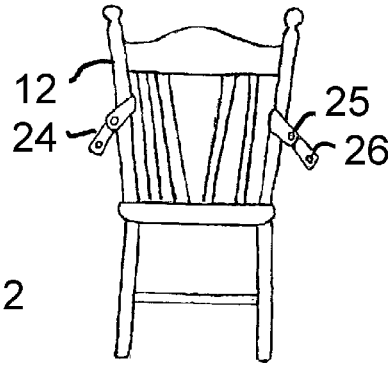
FIG. 4*b* is a front plan view of two of the safety-straps illustrated in FIG. 4*a* attached to the back of a chair ready for use.
Figure 4C:
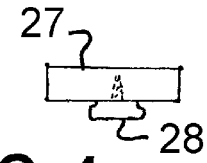
FIG. 4*c* is a detail side plan view of the male portion of the grommet snap attachment means screwed into an attachment block, where the attachment block may be attached to the table using an adhesive or double sided tape.

It is also obvious, to one having ordinary skill in the art, that the invention is not necessarily limited to the coupler made up of male part 18*a* and female part 18*b*, or to slide buckle 16. Another embodiment of the invention takes this into account and is illustrated in FIG. 4*a*. Here the attachment means is a grommet snap made up of male portion 26 and female portion 28. Male portion 26 is illustrated attached to strap 24 and female portion 28 is intended to be secured to a table using, in this example, a grommet ended screwing means. A series of grommet snaps 25 (only one is shown) replaces the use of a buckle, as illustrated in FIGS. 1, 2, and 3*a*, to provide for the adjustability that will likely be desired in securing strap 24 to chair 12, as well as providing for a means for tightening the chair to the table. Like slide buckle 16, grommet snaps 26 allow for quick and easy tightening of device 20, which could be done u21 sing only one hand. In this embodiment grommet snaps 26 and 28 could be made from, but are not limited to, plastic or metal, however, in the embodiment shown in FIG. 4*a*, female portion 28 of the snap is meant to be screwed into the table 27, therefore, in this case female portion 28 would likely be made of metal and the table of a material that would permit the use of a mechanical means of attachment 19. Such materials include, but are not limited to wood, plastic, and any other suitable material. Alternatively, grommet/screw 28 could be inserted into an attachment block of any utilitarian material and the block attached to a table via adhesive backing on the block 27.

Figure 5:
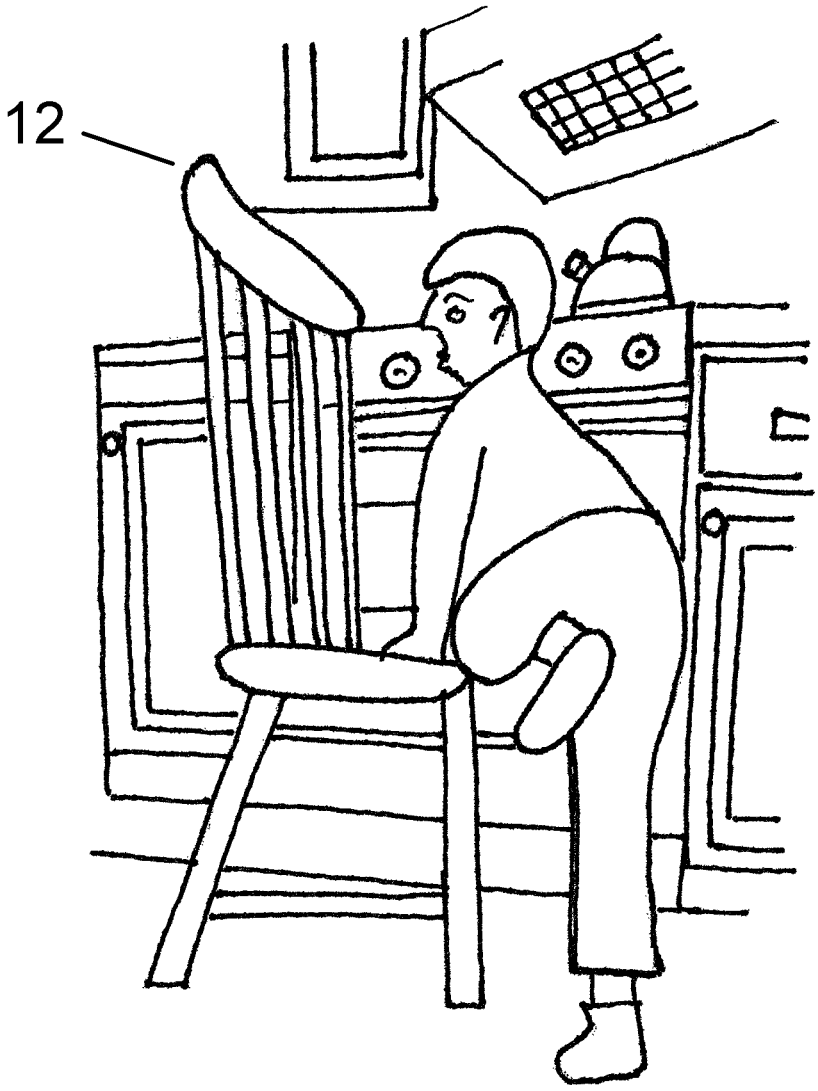
FIG. 5 is a perspective view illustrating a child using a self-standing chair for climbing.

FIG. 5, a perspective view, illustrates a child placing himself in a dangerous position using a self-standing chair for climbing. In this example, the child has moved the chair from the kitchen table in order to climb up to see or reach what is on the stove. This could end up as a terrible burn for the child.

Figure 6:
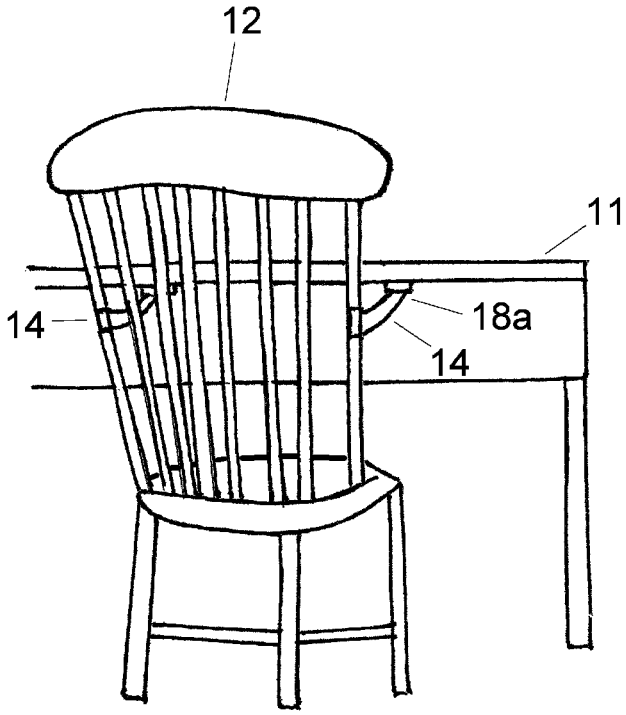
FIG. 6 is a partial perspective view illustrating a self-standing chair attached to a table (note the chair seat is not illustrated completely under the table to allow the chair attachment part to be shown attached to the table attachment part that has been attached to the underside of the table).

FIG. 6, a partial perspective view, illustrates a self-standing chair attached to a table preventing a child from using the chair for climbing. Note the chair seat is not illustrated being completely under the table to allow the chair attachment part to be shown attached to the table attachment part that has been attached to the underside of the table.

Figure 7:
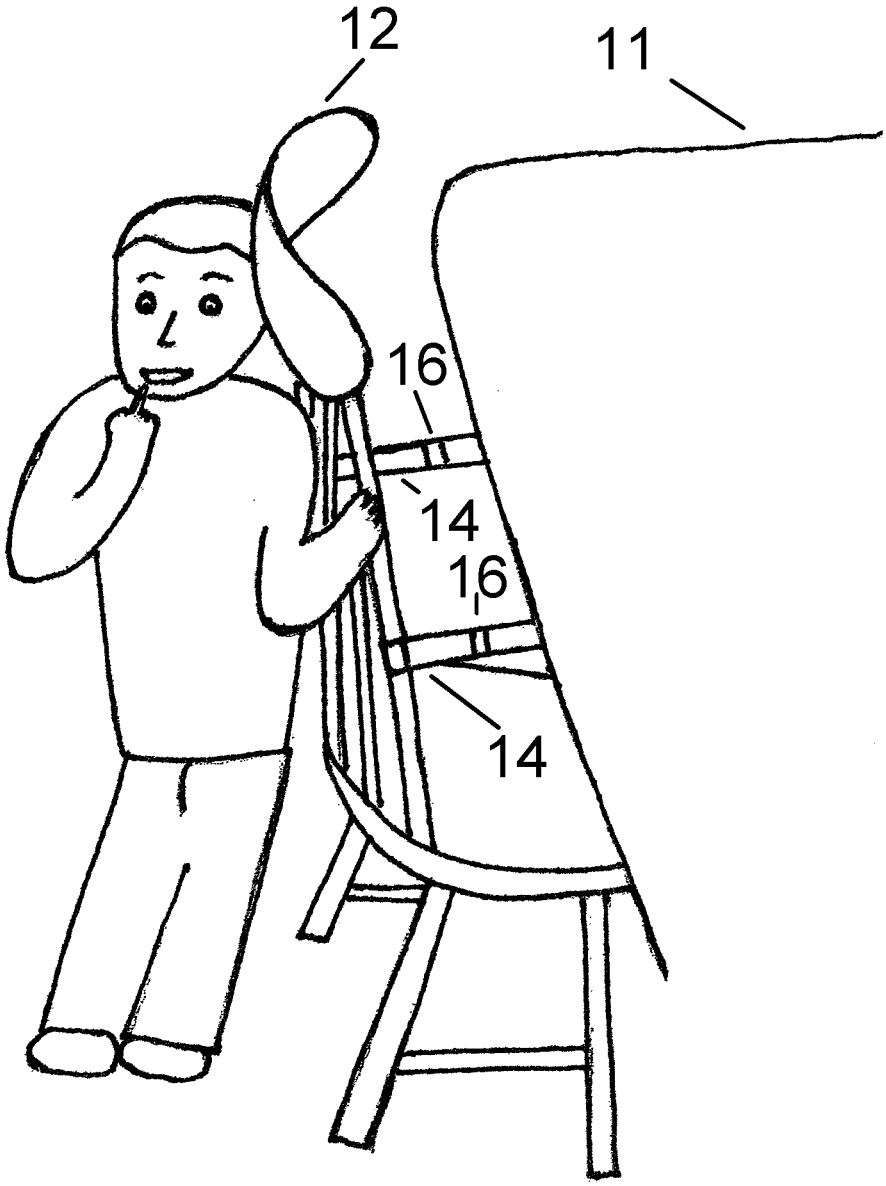
FIG. 7 is a perspective view illustrating a child who is not able to use the self-standing chair securely attached to the table for climbing.

FIG. 7, a perspective view, illustrates a child who no longer is able to position the self-standing chair for climbing as the chair is now securely attached to the table. Again, note the chair seat is not illustrated being completely under the table to allow the chair attachment part to be shown attached to the table attachment part that has been attached to the underside of the table.

It has been shown then that kitchen chair safety-strap attachment device prevents a child from using a self-standing chair for climbing. For one, the invention according to what has been taught, provides an adjustable restraint that is readily adaptable to a variety of sizes of chairs and tables. Moreover, device 10 can be adjusted quite easily and quickly, even if only one hand is available. Additionally, the size of the invention makes it quite portable, and ideal for use by any number of persons who have concerns about children using chairs as a means to get to higher places. Importantly, the invention provides for an device that is easy to make out of easily available materials and by inexpensive methods of manufacture, making the device affordable to all. Moreover, the size of the invention provides for it to be sold as several pairs in a kit.

The foregoing description, for purposes of explanation, used specific and defined nomenclature to provide a thorough understanding of the invention. However, it will be apparent to one skilled in the art that the specific details presented are not required in order to practice the invention and are not intended to be exhaustive or to limit the invention to the precise forms disclosed. Those skilled in the art will recognize that many changes may be made to the features, embodiments, and methods of making the embodiments of the invention described herein without departing from the spirit and scope of the invention. The invention is limited only by the claims.

What is claimed is:

1. An attachment device (10), comprising:

an attachment device arranged so as to detachably attach a self-standing legged chair (12) to a self-standing table (11) such that the seat of the chair (12) is unable to be used for climbing upon, said attachment device comprising:

a pair of attachment sets, each set comprising:

a table attachment part (2) structured to attach to an underside of the self-standing table (11) using a bolt, a screw, a tape, or an adhesive and so prevents marking the table's top surface, and a length adjustable chair attachment strap (4) of cloth or plastic designed to be detachably looped about a leg, a brace, a rail, a spindle, or an arm of the chair (12) and detachably attachable to said table attachment part (2), so that when for said first set said table attachment part (2) is attached to the underside of the table (11) and said chair attachment strap (4) is detachably looped about a leg, a brace, a rail, a spindle, or an arm of the chair (12) and said chair attachment strap and said table attachment part (2) are attached to each other and for said second set said table attachment part (2) is attached to the underside of the table (11) and said chair attachment strap (4) is detachably looped about a leg, a brace, or an arm of another side of the chair (12) and said chair attachment strap (4) and said table attachment part (2) are attached to each other, the chair (12) is held secure to the table and, thus, cannot be used for climbing.

2. The attachment device, as recited in claim 1, wherein said attachment part (2) further comprises a short strap (30).

3. The attachment device, as recited in claim 1, wherein said surface attachment part and said chair attachment strap are attachable to each other using a coupler.

4. The attachment device, as recited in claim 3, wherein the coupler is a side release buckle clip having a first part (18*b*) having a connector-aperture (15) so arranged as to attach said attachment part (2) to the underside of surface (11) using said bolt, said screw, or said adhesive.

5. The attachment device, as recited in claim 1, wherein said chair attachment strap (14) has a first end and a second end.

6. The attachment device, as recited in claim 5, wherein said first end comprises a second part (18*a*) of said side release buckle clip.

7. The attachment device, as recited in claim 5, wherein said second end is structured into a loop for the detachable attachment of said second end of said strap about a part of a chair.

8. The attachment device, as recited in claim 7, wherein said second end further comprises an adjustable slide buckle (16) to affix said second end of said strap to itself to form said loop.

9. The attachment device, as recited in claim 7, wherein said second end of said strap is fitted with one or more adjustable grommet snaps (26, 28) to affix said second end of said strap to itself to form said loop.

10. The attachment device, as recited in claim 8, where said loop is arranged so as to be looped around a portion of the chair.

11. The attachment device, as recited in claim 10, further comprising wherein said portion of the chair is either a leg, a brace, a rail, or an arm of one side of the chair.

12. The attachment device, as recited in claim 1, and wherein said surface is a free-standing table (11) with at least one leg supporting the table on a surface and said chair (12) further comprises at lease one leg supporting said chair on the surface.

13. The attachment device, as recited in claim 1 is sold in a kit of a sufficient number of devices to secure the chairs that are provided with well-known dinning room or kitchen table and chair sets.

14. A child safety device, comprising:

a chair to table attachment device arranged so to detachably attach a self-standing legged chair (12) to a bottom table-top surface of a self-standing table (11) such that the seat of the chair (12) is unable to be used for climbing upon, said attachment device comprising:

a pair of two-part sets, each set including a table attachment part (2) attachable to the bottom surface of a tabletop of a glass, metal, wood, stone, or plastic table using double-sided adhesive tape preventing marking the top surface, and a length-adjustable chair attachment strap (4) of cloth or plastic designed to be detachably looped about a leg, a brace, a rail, spindle, or an arm of one side of the free-standing legged glass, metal, wood, stone, or plastic chair, said table attachment part (2) and said chair attachment strap (4) detachably attachable to each other using a male/female buckle attachment device, so with said table attachment part of each set attached to the underside of the table using double-sided adhesive tape and said chair attachment strap of each set detachably looped about a leg, a brace, a rail, or an arm of each sides of the chair and said chair attachment strap of each set attached to its corresponding said table attachment part (2), the chair is held secured to the table preventing said chair from being climbed upon.

15. A method for preventing a child from using a chair for climbing, said method comprising:

providing for an attachment device arranged so as to detachably attach a self-standing legged chair (12) to a self-standing table (11) so that the seat of the chair (12) is unable to be used for climbing upon, said attachment device comprising:

a pair of attachment sets, each set comprising a table attachment part (2) structured to attach to an underside of the self-standing a table (11) using a bolt, a screw, a tape, or an adhesive and so prevents marking the table's top surface, and a length-adjustable chair attachment strap (4) of cloth or plastic designed to be detachably looped about a leg, a brace, a rail, or an arm of the chair (12) and detachably attachable to said table attachment part (2), attaching said table attachment part (2) of each set to the underside of the table (11), detachably looping said chair attachment strap (4) of each set about a leg, a brace, a rail, spindle, or an arm of the chair (12), and attaching said first set of said chair attachment strap (4) and said table attachment part (2) are attached to each other, and attaching said second set said chair attachment strap (4) and said table attachment part (2) are attached to each other, the chair (12) is held secured to the table and, thus, cannot be used for climbing.

* * * * *